United States Patent [19]

Cramer et al.

[11] Patent Number: 4,772,380

[45] Date of Patent: Sep. 20, 1988

[54] CHUTE FEEDER FOR CHIP WRINGER

[75] Inventors: Gerhardt H. Cramer; Robert T. Fritz, both of Kalamazoo, Mich.

[73] Assignee: French Systems, Inc., Rochester, N.Y.

[21] Appl. No.: 11,662

[22] Filed: Feb. 5, 1987

[51] Int. Cl.[4] ..... B07B 4/02

[52] U.S. Cl. ..... 209/2; 209/137; 209/149; 209/208; 209/639; 210/801; 210/804; 210/534; 241/79.1

[58] Field of Search ..... 209/638, 639, 631, 707, 209/136, 137, 149, 2, 208, 210; 210/801, 804, 534; 241/79.1

[56] References Cited

U.S. PATENT DOCUMENTS

| | | | |
|---|---|---|---|
| 1,418,866 | 6/1922 | Denning | 209/136 |
| 2,203,821 | 6/1940 | Hinchman | 209/139.1 |
| 3,356,213 | 12/1967 | Weber | 209/638 |
| 3,799,339 | 3/1974 | Breitholtz et al. | 209/639 |
| 3,952,645 | 4/1976 | Satake | 210/375 |
| 4,310,417 | 1/1982 | Dudley et al. | 99/524 |
| 4,382,858 | 5/1983 | Dudley | 209/136 |
| 4,441,995 | 4/1984 | Dudley | 209/137 |

FOREIGN PATENT DOCUMENTS

| | | | |
|---|---|---|---|
| 0605648 | 5/1978 | U.S.S.R. | 209/136 |

*Primary Examiner*—Robert B. Reeves
*Assistant Examiner*—Donald T. Hajec
*Attorney, Agent, or Firm*—Shlesinger, Fitzsimmons & Shlesinger

[57] ABSTRACT

A mixture of cooling liquids and solid pieces of waste from machine tools drop onto an inclined bottom wall of the upper, generally vertically disposed section of an inverted, generally Y-shaped feed chute. One of the two lower, diverging chute sections extends downwardly and rearwardly beneath the upper chute section to a chip wringer, and has its upper end positioned beneath the lower edge of the inclined bottom wall of the upper section to receive the liquids and lighter pieces of waste which tend to drop by gravity into this one lower section. The other lower section of the chute is in general alignment with the inclined bottom wall of the upper section to receive the larger pieces of waste which, because of their momentum or size pass beyond the one lower section and into the other lower section. A stream of air which is directed transversely across the lower end of the upper section blows the remaining liquids and light waste into the one lower section.

12 Claims, 3 Drawing Sheets

CHUTE FEEDER FOR CHIP WRINGER

BACKGROUND OF THE INVENTION

This invention relates to the recovery of machine tool cutting or cooling liquids, and more particularly to apparatus of the type which utilizes chip wringers for separating cooling or cutting liquids from the waste produced by lathes, milling machines, drills, and the like. Even more particularly this invention relates an improved chute feeding device for supplying a mixture of cooling or cutting liquid and chips, turnings, bar ends, tramp metal and the like to a chip wringer for separation thereby.

Because of both the economies of operation and environmental considerations, it has long been customary to retrieve cooling and/or cutting liquids and lubricants which are directed onto the cutting tools of machine tools, such as lathes, milling machines, drills, and the like during a cutting operation. The plastic and/or metal turnings, chips, bar ends and tramp metal produced during such an operation are conveyed along with the cooling and/or cutting liquid to known apparatus of the type which separates the liquid from the solid waste, so that the liquid can be reused or disposed of without causing environmental contamination. Typically such separation occurs in a device known as a chip wringer, wherein mixtures of the liquid (cooling fluids) and solid waste (chips, turnings, etc.) are subjected to centrifugal forces that separate the liquid from the solid waste. Conventional chip wringers are disclosed, by way of example, in U.S. Pat. Nos. 3,233,735, 3,366,318, and 3,850,814.

As noted above, the waste or by-products produced by tools of the type described include not only small chips and turnings, but also rather large or heavy bar ends and tramp pieces of plastic or metal, which along with the chips, turnings and cooling fluids are delivered to the separating apparatus. However, because of the nature of the operation of chip wringers of the type described, it has been found most desirable to separate out the heavy or larger ends and tramp pieces from the waste before the latter is fed into the chip wringer. This preliminary separation is most important when the chip wringer comprises a rotating separator bowl or centrifuge of the type having radially inwardly projecting fins or baffles that strike the incoming waste products as they are fed into the rotating bowl. If the heavier pieces in the waste are allowed to enter the bowl they may jam or damage the bowl or its related equipment; and if they happen to pass through the wringer, they can cause problems downstream thereof, for example by plugging pneumatic conveying systems or the like.

One such means for effecting preliminary separation of the heavier parts from machine tool waste is disclosed in U.S. Pat. No. 4,310,417. With this apparatus waste products from machine tools are fed down an inclined feed chute into the bowl-shaped separator of a conventional chip wringer. The rotating separator bowl generates at the lower end of the chute a vacuum, which is utilized to draw the fluids and lighter metal chips down the chute into the wringer. An opening located in the bottom of the chute above its lower end permits the heavier waste materials (large end pieces and the like) to drop by gravity downwardly through the opening and out of the chute before reaching its lower end, so that the heavier pieces are not fed into the separator bowl of the wringer. Air rushing into the chute through the opening entrains the lighter waste materials (chips, etc.) and fluids and carries them over the opening so that they continue to pass downwardly out of the lower end of the chute and into the separator bowl.

One of the primary disadvantages of this conventional feed chute is that it is necessary to maintain a vacuum or suction in the chute throughout its length, and specifically at the opening through which the larger pieces drop. In other words, it is essential that the vacuum created by the wringer's rotating separator bowl be great enough to carry the lighter waste materials (chips, etc.) and cooling fluids or liquids over the opening in the bottom of the chute through which the heavier materials or bar ends drop. For this reason, such chute opening must be small enough to cause the entering air to reach a velocity great enough to overcome the gravitational forces which otherwise would cause the liquid and lighter waste particles (chips,turnings, etc.) also to drop out of the opening in the chute with the heavier materials. Since there is a limit to the vacuum which can be created by the rotating separator bowl, it is very critical that the entire feed chute be carefully sealed, except for the above-noted opening in the bottom thereof. Otherwise, it would be impossible to draw through the opening air in a quantity sufficient to entrain and cause the liquids or fluids and small chips to pass over the opening, and downwardly in the chute to the wringer.

This necessity for carefully selecting the size of the opening in the bottom of the chute also causes ancillary problems. For example, because the opening in question must be limited in size, it has been found that in many instances particularly long pieces of incoming waste materials tend to pass over the opening and slide downwardly in the chute to the wringer, where they often cause excessive damage to the wringer or to downstream equipment. This problem is particularly acute when the waste contains a finished part or tramp piece which accidentally may have become entrained in masses of wire or metal scrap turnings, and which therefore tends to pass over the opening in the bottom of the chute along with the cooling liquid and smaller chips.

It is an object of this invention, therefore, to provide for chip wringers of the type described an improved chute feed mechanism which is substantially more efficient than prior such mechanisms, and which obviates the need for maintaining a vacuum throughout the length of the associated chute.

Still another object of the invention is to provide for chip wringers and the like an improved, inclined feed chute which is designed to utilize both gravity and a stream of air for blowing lighter waste products and fluids transversely out of an opening which is located in the feed chute intermediate its ends.

A further object of this invention is to provide an improved, inverted, generally Y-shaped feed chute of the type described, which has adjustable vent means for controlling a stream of air used to assist in separating lighter particles and fluids from falling machine tool waste materials.

Another object of this invention is to provide an improved feed chute of the type described, which has an adjustable bypass mechanism for selectively interrupting the flow of lighter waste materials and fluids out of the chute to the associated chip wringer, thereby discharging all of the incoming waste material, out of the lower end of the chute.

Other objects of the invention will be apparent hereinafter from the specification and from the recital of the appended claims, particularly when read in conjunction with accompanying drawings.

SUMMARY OF THE INVENTION

Machine tool waste (cooling liquids, chips, turnings, bar ends, etc.) is delivered by a screw conveyor to the upper end of an inverted, generally Y-shaped chute. The upper, vertical section of the chute opens at its lower end on the upper ends of the two lower sections of the chute, which are inclined downwardly and in opposite directions away from the lower end of the upper chute section. One of the inclined, lower sections of the chute opens at its lower end on the separating bowl of a chip wringer, which during operation of the equipment generates a vacuum or suction that causes air to be drawn through an opening in at least the upper chute section and transversely across its lower end, and into the upper end of the inclined section that feeds the separating bowl.

As waste material drops through the upper section of the chute, gravity tends to draw the waste into the upper end of the chute section which feeds the separating bowl. However, the momentum of the heavier solids in the waste (bar ends, tramp metal, etc.) causes these heavier pieces to pass by or to fall beyond the upper end of the bowl feeder section, and to pass instead through the other lower section of the chute. Although the stream of air passing across the lower end of the upper chute section does not have any significant effect on the trajectory of the heavier pieces of waste, it does in fact tend to blow the lighter waste materials and liquids laterally and into the upper end of the bowl feeder section, thus supplementing the gravitational forces which also cause the lighter waste and liquids to enter the bowl feeder section.

If it is desired to interrupt the feed to the wringer, a bypass plate which is slidably mounted on the upper chute section may be moved manually from a retracted to an advanced position in which it overlies the upper end of bowl feeder section of the chute, thus directing all waste into the other inclined section. Also, means is provided for adjusting the direction and quantity of the transverse air stream which enters the bowl feeder section.

THE DRAWINGS

PREFERRED EMBODIMENTS OF THE INVENTION

Figure 1:
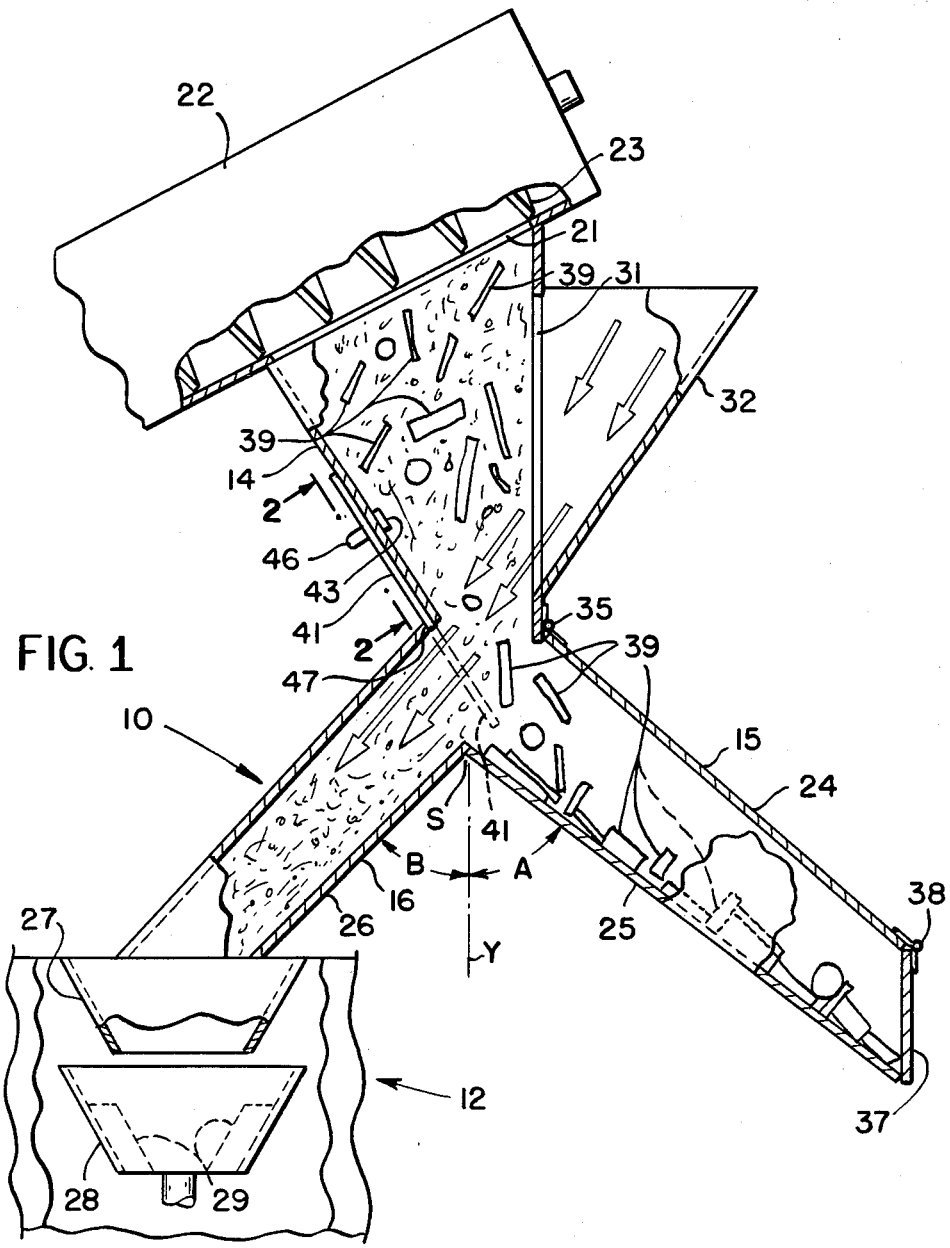
FIG. 1 is a fragmentary elevational view of a chip wringer chute feed mechanism made according to one embodiment of this invention, the chute mechanism being shown as it appears in combination with a conventional chip wringer, and with portions of the chute being broken away and shown in section for purposes of illustration.
Figure 2:
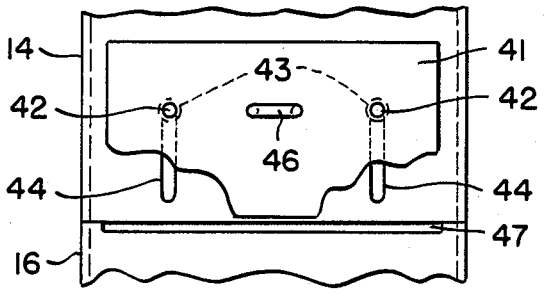
FIG. 2 is a fragmentary sectional view taken generally along line 2—2 in FIG. 1 looking in the direction of the arrows.
Figure 3:
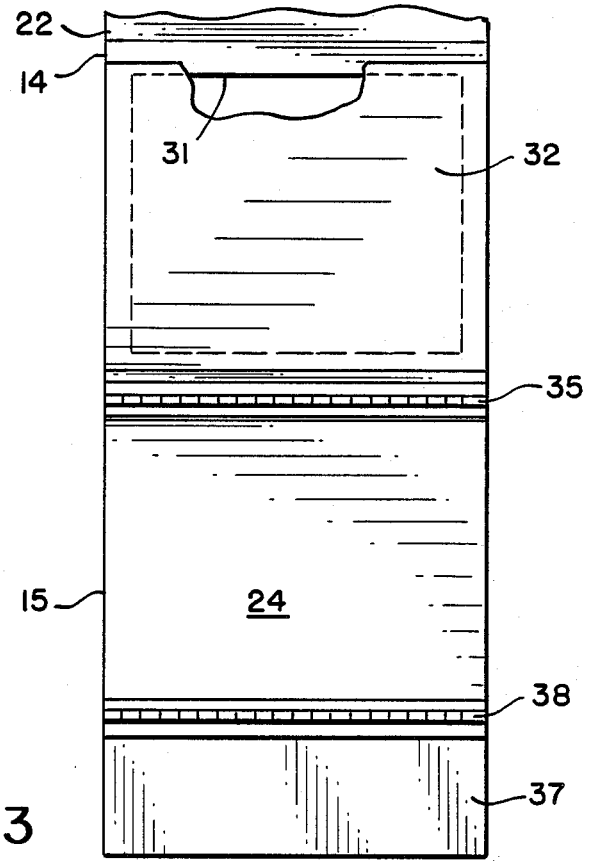
FIG. 3 is a fragmentary side elevational view of this feed chute mechanism as seen when viewed from the right side as shown in FIG. 1.

Referring now to the drawings by numerals of reference and first to FIGS. 1 to 3, 10 denotes generally a chute feed mechanism which is particularly suited for use with conventional chip wringer apparatus of the type denoted generally at 12 in FIG. 1. Chute mechanism 10 comprises three, intersecting chute or conduit sections 14, 15 and 16, which in elevation are somewhat in the configuration of an inverted "Y". The upper, generally vertically disposed chute section 14 communicates at its upper end with an opening 21 formed in the underside of a conventional screw conveyor housing 22. Housing 22 contains a rotating screw feeder 23 that operates in a conventional manner to convey a mixture of solid and liquid wastes (turnings, chips, bar ends, tramp pieces, coolants, lubricants) from machine tools to the upper end of housing 22, from where the mixture is discharged through opening 21 into the upper end of the chute section 14, and onto the inclined bottom wall thereof.

Adjacent its lower end chute section 14 communicates with the upper ends of each of the chute sections 15 and 16, which extend downwardly and away from opposite sides, respectively, of a vertical plane denoted by the line Y in FIG. 1. The plane Y extends through the seam S, which is formed at the juncture of the upper edges of the bottom walls 25 and 26 of the chute sections 15 and 16, respectively, and which is offset slightly to the left, as shown in FIG. 1, from the center of the lower end of chute section 14. Also as shown in FIG. 1, the chute section 15 is inclined downwardly at an acute angle A relative to the vertical plane Y, while the chute 16 is inclined downwardly at an acute angle B relative to plane Y. Merely for purposes of illustration, the angle A may be approximately 50°, while angle B may be approximately 45°.

As shown in FIG. 1, the lower end of the chute section 16 communicates with the upper, funnel-shaped section 27 of the chip wringer 12. Section 27 overlies and registers with the upper end of the rotatable separator bowl 28 of the wringer. This bowl 28 is of the type which has internal radial fins or baffles 29.

The side of the upper chute section 14 remote from chute section 16 (the right side of 14 as shown in FIG. 1) lies in a vertical plane and has therein a large, rectangularly shaped air-inlet opening 31. Opening 31 communicates with the surrounding atmosphere through the upper, open end of a rigid, generally triangularly shaped duct or shroud 32, which is secured to and projects outwardly from chute section 14 around the lower and opposed side edges of opening 31. Duct 32, as noted hereinafter, serves to direct a stream of air through the opening 31 and transversely across the lower end of chute section 14 and into the upper end of the chute section 16.

Also as illustrated in FIG. 1, the upper wall 24 of the chute section 15 is pivotally connected adjacent its upper edge by a piano hinge 35, or the like, to the lower edge of the vertical wall of chute section 14 that contains the opening 31. This permits the upper wall of chute section 15 to be swung upwardly to an open position to permit access to the interior of chute section 15 for cleaning purposes and the like. Also, the lower end of chute section 15 normally is closed by a pivotal plate or valve flap 37, which is pivotally connected adjacent its upper edge to the upper wall 24 of the chute section 15 by a piano hinge 38. If desired, the valve flap 37 may be spring-loaded into its closed position.

Slidably mounted on the underside of the inclined bottom wall of chute section 14 adjacent its lower end is a rectangularly shaped metal plate 41. Two pins 42 (FIG. 2), which project from the underside of plate 41 slidably through registering slots 43 in the bottom wall of chute section 14, have enlarged diameter heads 44 that support plate 41 slidably on chute section 14. Plate 41 has an integral handle 46 by means of which it is adapted to be shifted into and out of its inoperative or full line position as shown in FIG. 1. The lower end of plate 41 registers with a slot 47 (FIG. 2) in the upper wall of the chute section 16. This slot permits the plate 41 manually to be shifted by its handle 46 downwardly in FIG. 1 from its solid to its broken line position, wherein the plate overlies the upper end of the chute section 16, and the lower wall of the chute section 15 adjacent the upper edge of the latter. In this position the plate 41 operates to cause the incoming waste materials to bypass the chute section 16, thus delivering all incoming materials directly from chute section 14 into the chute section 15. This is particularly advantageous whenever it is desired instantly to cut off the flow of materials from the chute 10 into the chip wringer 12.

In use, machine tool waste materials are conveyed by the screw conveyor 23 upwardly in the housing 22 from where they drop through the opening 21 into the chute section 14. As illustrated in FIG. 1, this waste material includes, in addition to cooling and/or cutting fluids and small chips or turnings, a variety of large bar ends and tramp pieces 39.

When the chip wringer 12 is operating, its rotating separator bowl 28 generates at the lower end of chute section 16 a vacuum which causes air to be drawn inwardly through the duct 32, the opening 31 and transversely across the lower end of the chute section 14 into the chute section 16, and generally along the path indicated by the arrows in FIG. 1. In so doing, the air stream tends to blow laterally into the upper end of the chute section 16 any liquids and lighter solid particles in the waste materials (small chips, turnings, etc.) which otherwise might drop to the right of the seam S (FIG. 1) and into chute section 15.

On the other hand, the heavier bar ends and tramp pieces 39 in the waste are caused by gravity and their momentum to slide or fall downwardly from chute section 14 past the upper end of the bowl feeding section 16, and into the upper end of chute section 15. The transverse air flow from the duct 32 into the chute section 16 thus has substantially no effect on these larger waste pieces. As shown in FIG. 1, these larger or heavier solids 39 therefore collect in the chute section 15, from where they are eventually discharged out of its lower end whenever the flap 37 is opened.

In practice flap 37 may be releasably secured in its closed position, or alternatively, it can be mounted automatically to pivot about the hinge 38 to its open position whenever the weight of the heavy pieces that accumulate in chute section 15 exert sufficient pressure on the flap 37 to cause it to open.

Figure 4:
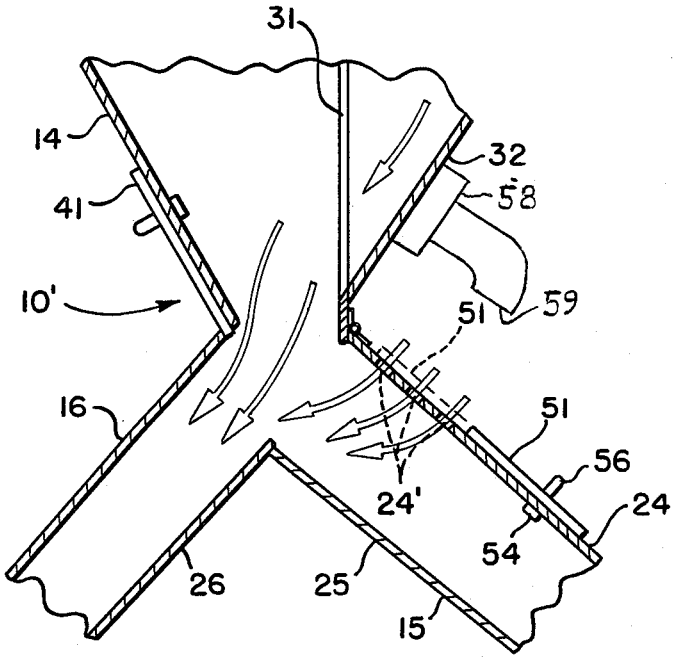
FIG. 4 is a fragmentary sectional view generally similar to FIG. 1, but showing a modified form of this chute feed mechanism.

Referring now to the embodiment shown in FIG. 4, wherein like numerals are employed to denote elements similar to those used in the first embodiment, 10′ denotes a modified chute mechanism in which the cover 24 of chute section 15 has therein a plurality of vent slots 24′ for selectively admitting air to the upper end of chute section 15 opposite the upper end of section 16. For this purpose an adjustable vent cover in the form of a rectangular plate 51 is slidably mounted on the upper face of cover or wall 24 of chute section 15 for sliding movement by a handle 56 between an open position (full lines in FIG. 4) in which slots 24′ are uncovered, and a closed position,(broken lines in FIG. 4) in which plate 51 covers or seals slots 24′.

Plate 51 is slidably mounted on wall 24 by pins which extend through slots in wall 24, and which have enlarged diameter heads 54 that slidably support the plate 51 on wall 24 in a manner similar to that in which plate 41 is mounted on chute section 14. Also, a blower 58 may be mounted on or near the chute mechanism, for example on duct 32 as shown in FIG. 4, so as to have its outlet 59 directed toward the vent openings in wall 24 as shown in FIG. 4 (or alternatively directed into duct 32) to supplement the air flow caused by the vacuum generated by the chip wringer 12.

This second embodiment is particularly suited for those operations in which it is desirable to direct a stream of air across both the upper and lower edges of the entrance to section 16 from both upstream and downstream directions. This construction permits the operator more readily to balance the incremental intensity and direction of the transverse air stream or streams which transverse the path of the falling waste materials to enter the upper end of section 16.

From the foregoing it will be readily apparent that the present invention provides extremely efficient and reliable means for removing liquids and light-weight solid materials from machine tool waste, while permitting the heavier pieces of the waste to drop by gravity downwardly to chute section 15. Most of the liquids and lighter solids which slide down the inclined bottom wall of upper section 14 drop by gravity directly into the upper end of section 16. This is because seam S (FIG. 1) is laterally offset (to the right in FIG. 1) from the lower edge of the inclined bottom wall of section 14, whereby the lower end of section 14 registers in part with each of the upper ends of sections 15 and 16. To insure that the remaining liquid and lighter materials in the falling waste are also caused to enter section 16, a stream of air is deliberately introduced into the upper end of section 14 and/or 15, and is directed transversely across the chute into the chute section 16, thus removing all lighter materials and liquids from the waste without causing the heavier materials to enter the chute section 16. The momentum and sizes of the latter materials, on the other hand, cause them to continue to drop downwardly beyond the section 16 and into the chute section 15, from which they eventually are discharged from the lower end of the latter.

In practice it has been found that for most operations the equipment as shown in FIG. 1 performs satisfactorily regardless of whether or not the upper wall 24 of section 15 and/or the valve plate 37 are in their closed or opened positions. In other words, there normally is no need to maintain any vacuum in the chute section 15. For other operations, however, it might be advantageous to close these elements and to control the transverse air stream by plate 51.

Moreover, it has also been discovered that there is no need to seal the upper end of the chute section 14, nor for that matter housing 22. As a matter of fact, instead of utilizing the duct 32, any desired means can be employed for permitting air to enter the upper end of section 14. It is desirable, however, that an air stream be directed transversely across the lower end of section 14 and into the upper end of the chute section 16, either solely by virtue of the vacuum created at the lower end of section 16 by the rotating separator bowl 26, or in combination with supplemental means for creating such an air stream.

The apparatus disclosed herein thus functions as a qualifier for chips, assuring that the lighter chips and fluids will be discharged into the chute section 16, while the heavier portions of the waste will drop downwardly beyond the upper end of chute 16, and directly into the chute section 15. This is particularly advantageous in the case of long bar ends or tramp pieces which may be discharged into the chute 14. Such bars or pieces, even if they happen to be entangled in a mass of turnings or the like, will in any case end up in the chute section 15, since the air stream entering the upper end of the chute section 16 will not be sufficient to deflect such heavy pieces into section 16.

It should be understood that the waste materials as illustrated in the drawings (e.g.pieces 39) have been shown merely to illustrate, generally, the paths followed, for example, by the heavy and light solids, respectively. In other words, the waste is not discharged through the opening 21 in housing 22 exactly as shown in the drawings. In practice, most of the waste drops onto and slides down the inclined wall of chute section 14.

While this invention has been illustrated and described in connection with only certain embodiments thereof, it will be apparent that it is capable of still further modification, and that this application in intended and such modification as may fall within the scope of one skilled in the art or the appended claims.

We claim:

1. In combination with a chip wringer of the type having an inlet, and a rotating separator bowl for creating a vacuum in said inlet of the chip wringer, and a machine tool waste conveyor having a conveyor outlet positioned above said chip wringer and operative to convey to the conveyor outlet a mixture of cutting tool liquids and solid waste, including relatively large, heavy waste pieces and relatively small, light waste pieces, respectively, an improved chute feed mechanism interposed between said waste conveyor outlet and said chip wringer inlet, and comprising a first, generally vertically disposed chute section communicating at its upper end with said waste conveyor outlet, and having at least one wall thereof inclined to the vertical and positioned beneath and in registry with said conveyor outlet to receive waste discharged therefrom, a pair of inclined chute sections communicating at their upper ends with the lower end of said first chute section, each of the chute sections of said pair having openings in its upper and lower ends, respectively, and being inclined downwardly and generally in opposite directions from each other and and away from said first chute section, one of said inclined chute sections being connected at its lower end to said chip wringer inlet, and having the opening in its upper end positioned beneath and in vertical registry with the lower end of said inclined wall of said first chute section, and disposed and in overlapping vertical registry with a first portion of the opening in the lower end of said first chute section, the opening in the upper end of the other of said inclined chute sections being disposed in vertical registry with the remaining portion of said opening in the lower end of said first chute section, and means for directing a stream of air transversely across the lower end of said first chute section and into the upper end of said one inclined chute section, thereby to assist gravity in causing the liquids and lighter waste pieces dropping from said first chute section to be blown into said one inclined chute section for delivery to said chip wringer, while permitting the momentum of the heavier waste pieces in said mixture to carry the heavier pieces beyond said one inclined chute section and into the other of said inclined chute sections.

2. The combination as defined in claim 1, including bypass means mounted on said first chute section for movement between an inoperative position in which it does not impede the flow of waste liquids and light solids into said one inclined chute section, and an operative position in which it overlies the upper end of said one inclined chute section to cause all waste materials from said first chute section to pass by said one inclined chute section and to enter said other inclined chute section.

3. The combination as defined in claim 1, including means releasably closing the lower end of said other inclined chute section.

4. In combination with a chip wringer of the type having an inlet and a rotating separator bowl for creating a vacuum in said inlet of the chip wringer, and a machine tool waste conveyor having a conveyor outlet positioned above said chip wringer and operative to convey to the conveyor outlet a mixture of cutting tool liquids and solid waste, including relatively large, heavy waste pieces and relatively small, light waste pieces, respectively, an improved chute feed mechanism interposed between said waste conveyor outlet and said chip wringer inlet, and comprising a first, generally vertically disposed chute section communicating at its upper end with said waste conveyor outlet, and having at least one wall thereof inclined to the vertical and positioned beneath and in registry with said conveyor outlet to receive waste discharged therefrom, a pair of inclined chute sections communicating at their upper ends with the lower end of said first chute section, each of the chute sections of said pair having openings in its upper and lower ends, respectively, and being inclined downwardly and generally in opposite directions from each other and away from said first chute section, one of said inclined chute sections being connected at its lower end to said chip wringer inlet, and having the opening in its upper end positioned beneath the lower end of said inclined wall of said first chute section, and in vertical registry with a first portion of the opening in the lower end of said first chute section, the opening in the upper end of the other of said inclined chute sections being disposed in vertical registry with the remaining poriton of said opening in the lower end of said first chute section, and means for directing a stream of air transversely across the lower end of said first chute section and into the upper end of said one inclined chute section, thereby to assist gravity in causing the liquids and lighter waste pieces dropping from said first chute section to be blown into said one inclined chute section for delivery to said chip wringer, while permitting the momentum of the heavier waste pieces in said mixture to carry the heavier pieces beyond said one inclined chute section, and into the other of said inclined chute sections, said means for directing said stream of air comprising duct means on said first chute section connecting an opening in a second wall of said first chute section with a source of air, whereby the vacuum created at said chip wringer inlet by said separator bowl draws air from said source in a stream successively through said duct means, across the lower end of said first chute section, and through said one inclined chute section to said chip wringer.

5. The combination as defined in claim 4, wherein said means for directing said stream of air further comprises, means releasably sealing the lower end of said other inclined chute section, and means for selectively opening and closing a plurality of vent openings formed in at least one wall of said other inclined chute section adjacent said lower end of said first chute section, said vent openings being operative, when open, to direct air transversely across the upper end of said other inclined chute section and into the upper end of said one inclined chute section in response to the vacuum generated at said inlet to the chip wringer.

6. The combination as defined in claim 5, including means pivotally connecting said one wall of said other inclined chute section to the lower end of said first chute section for movement into and out of an open position relative to the remaining walls of said other inclined chute section.

7. A method of separating liquids and lighter solids from the heavier solids in a mixture of cutting tool liquids and solid waste fed by a machine tool waste conveyor to an outlet thereof from which the mixture is allowed to drop, comprising positioning beneath said outlet a first chute having a downwardly inclined bottom wall onto which most of the mixture drops and slides downwardly out of an opening in the lower end of said first chute, positioning beneath and in registry with part only of said opening in the lower end of the first chute the upper end of at least a second chute, which is inclined downwardly beneath said bottom wall of the first chute, and in a direction generally opposite to that in which said mixture travels down said bottom wall, positioning a chip wringer mechanism beneath the lower end of said second chute with the inlet to said mechanism connected to the outlet in the lower end of the second chute, feeding said mixture of cutting tool liquids and solid waste into the upper end of said first chute so that said mixture slides downwardly in said first chute at a rate sufficient to permit the liquids and lighter solids in said mixture to drop by gravity into the upper end of said second chute while causing the momentum of the heavier solids in said mixture to fall past the upper end of said second chute, directing a stream of air transversely across the lower end of said first chute and into the upper end of said second chute, and at a rate sufficient to blow into said second chute liquids and lighter solids in said mixture which might otherwise tend to fall past said upper end of the second chute, and without causing said heavier solids to be blown into said second chute, wherein said stream of air is produced by said chip wringer mechanism having a rotating separator bowl operative to generate a vacuum at the lower end of said second chute, and by venting said first chute adjacent the upper end of said second chute, whereby the vacuum created by said separator bowl draws said stream of air transversely across the lower end of said first chute.

8. Apparatus for separating solids and liquids in machine tool waste materials, comprising an inverted, generally Y-shaped chute feeder having an upper, generally vertically disposed chute section, and a pair of lower chute sections communicating at their upper ends with the lower end of said upper section, and inclined downwardly and away from said lower end in generally opposite directions, respectively, a chip wringer connected to the lower end of one of said lower chute sections and operable to create a vacuum in said one lower section, a waste conveyor for feeding from an outlet thereof into the upper end of said upper chute section a mixture of machine tool cooling liquids and solid waste, including relatively small, light pieces and relatively large, heavy pieces, respectively, said upper chute section having therein an air inlet opening, and having opposite said opening an inclined bottom wall portion positioned adjacent its upper end beneath said conveyor outlet to receive waste therefrom, and registering at its lower end with the upper end of said one lower chute section to guide a major portion of the liquids and light pieces in said waste into the upper end of said one lower section, and to direct said heavier pieces into the other of said lower chute sections, and said air inlet opening serving as means for directing a stream of air transversely across the lower end of said upper chute section and into said one lower chute section to blow remaining portions of said liquids and light pieces of waste into said one lower section, while allowing said heavy pieces of waste to pass beyond said one lower section and to enter said other of said lower sections.

9. Apparatus as defined in claim 8, including means for releasably blocking the upper end of said one lower section during operation of said waste conveyor thereby to cause all of said mixture to pass from said upper chute section into said other of said lower chute sections.

10. Apparatus as defined in claim 8, including a plurality of vent opening formed in said upper and said other lower chute sections for admitting air from the exterior of said chute feeder and through said one lower chute section in response to the vacuum generated in the latter by said chip wringer, and means for selectively opening and closing at least certain of said vents to help control the direction and intensity of said air stream.

11. Apparatus as defined in claim 8, wherein the bottoms of said lower chute sections converge at a seam which registers with, and is slightly offset from, the center of the lower end of said upper chute section.

12. Apparatus as defined in claim 8, wherein the bottom of said other lower chute section is nearly parallel to, and approximates an extension of, the bottom wall of said upper chute section.

* * * * *